United States Patent [19]

Dickey

[11] 4,207,694

[45] Jun. 17, 1980

[54] FRAME WITH CONVERTIBLE EASEL SUPPORT

[75] Inventor: Avis M. Dickey, South Milford, Ind.

[73] Assignee: Dickey, Inc., South Milford, Ind.

[21] Appl. No.: 861,694

[22] Filed: Dec. 19, 1977

[51] Int. Cl.[2] ..... G09F 1/12

[52] U.S. Cl. ..... 40/152.1

[58] Field of Search ..... 40/158, 152, 152.1; 248/460, 463

[56] References Cited

U.S. PATENT DOCUMENTS

| | | | |
|---|---|---|---|
| 240,751 | 4/1881 | Newell | 40/158 R |
| 1,809,786 | 6/1931 | Le Jeune | 40/152 |
| 2,576,667 | 11/1961 | Bly | 40/152 |
| 3,341,961 | 9/1967 | Shanks | 40/158 R |
| 3,540,146 | 11/1970 | Warkins | 40/152.1 |
| 3,836,419 | 9/1974 | Hamberger | 40/152.1 |
| 3,886,677 | 6/1975 | Behring | 40/158 R |
| 4,014,120 | 3/1977 | Merz | 40/152.1 |
| 4,117,613 | 10/1978 | Hosker | 40/152.1 |

*Primary Examiner*—Louis G. Mancene
*Assistant Examiner*—Wenceslao J. Contreras

[57] ABSTRACT

For greeting card display an inexpensive, novel, centrally apertured, end-insertion, one-piece frame with attractive front design or coloring, employing a standing/hanging back triangular easel of wire or a double triangle back easel of frame backing material.

1 Claim, 10 Drawing Figures

FRAME WITH CONVERTIBLE EASEL SUPPORT

Picture frames have traditionally utilized outer decorative borders to hold transparent glass or plastic sheets to firm backing which, in turn, support and secure in viewing position within the frame aperture the art for display behind the aforesaid glass or plastic windows. Such frames usually intended for permanence and lasting beauty have proved quite costly. Those of lower cost variety generally have been designed for specific employment and have not readily proved adaptable to certain display usage.

Therefore the present invention is concerned with providing an inexpensive, attractive, one-piece frame for greeting card display, the uncomplicated employment of which makes readily possible its utilization by the younger, older, infirm, and limited-reasoning person, as well as his more normal counterpart, to exchange one greeting card for another within the frame and to stand or hang the frame for card viewing.

BRIEF SUMMARY OF THE INVENTION

The display assembly of the invention employs gluing or bonding of a narrow frame front of cardboard, plastic, leather, thin wood, or the like to a sheet of transparent plastic, the resulting panel being glued or bonded on three of its peripheral edges to the frame backing, thereby creating an end aperture for insertion of the greeting card. To the reverse of the backing is affixed a standing/hanging triangular easel of wire or a double triangular standing/hanging easel of backing material, either easel having a center baseline protrusion for standing and hanging.

A fuller understanding of the nature and objects of the invention may be had from the following detailed description taken in connection with the appended drawings wherein FIG. 1 is a perspective view of a frame front with greeting card in viewing position.

FIG. 3 is a perspective view of FIG. 2 with the wire standing/hanging easel extended for propping the frame in the standing or generally upright viewing position, while

FIGS. 5, 5B, 6, 6B, and 6C depict method of determining size, configuration, and attachment of standing-/hanging easels to frame backings.

DESCRIPTION OF PREFERRED EMBODIMENTS

Figure 1:
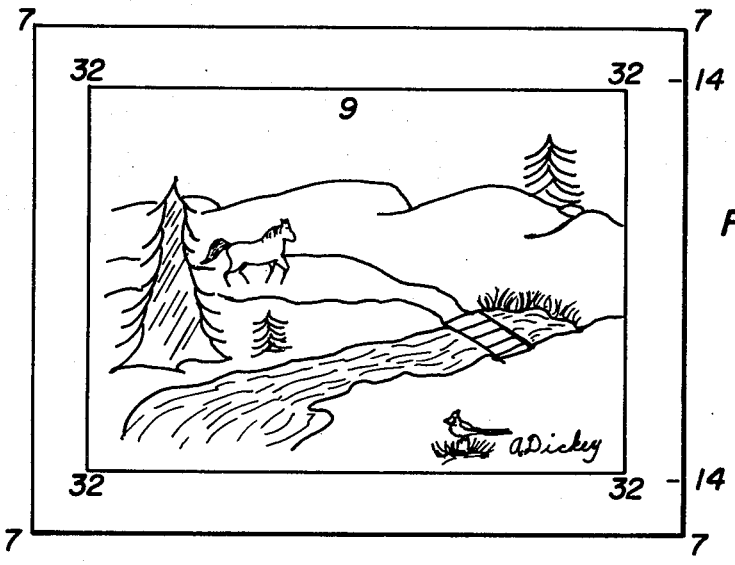

A simple and inexpensive form of the invention is shown in FIG. 1, wherein the decorated, colored, woodgrained or otherwise attractively enhanced, centrally apertured frame front of sturdy Bristolboard, plastic, thin wood, leather, or other comparable material has a perimeter 7 greater in each side measurement, such as $\frac{5}{8}''$, than its greeting card. Frame aperture 32 is smaller in each side measurement, such as $\frac{1}{8}''$, than that of its aforementioned card.

Figure 2:
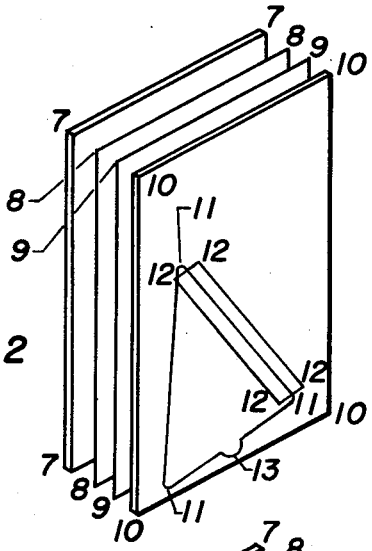
FIG. 2 is a perspective view of frame components in layered sequence with wire triangular standing/hanging easel employed.
Figure 3:
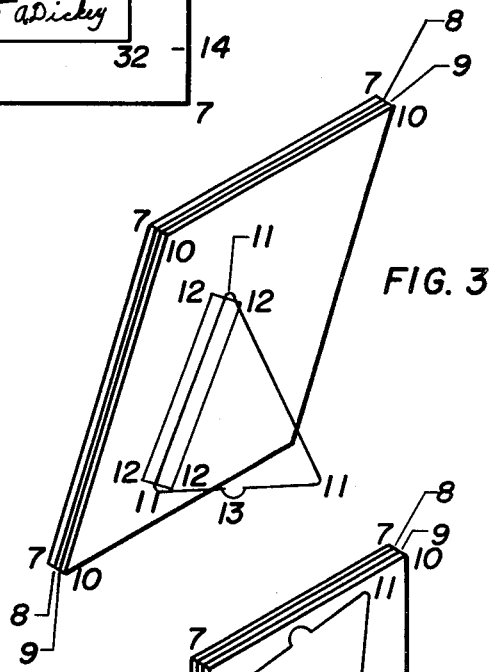
Figure 2B:
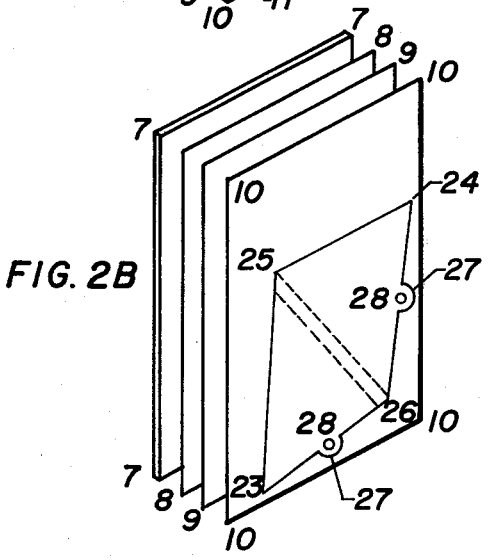
FIG. 2B is a perspective view of frame components in layered sequence with the double triangular frame backing standing/hanging easel employed.
Figure 4:
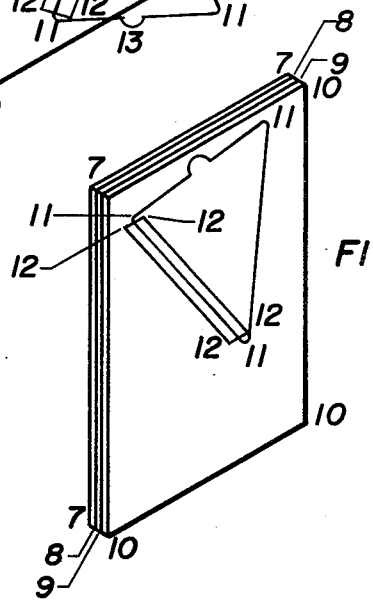
FIG. 4 depicts easel remaining in close proximity to the frame backing for hanging or wall display.

The asembled components FIG. 2 in ordered relation to each other are frame front 7 glued or bonded on total reverse to a sheet 8 of transparent plastic, such as 0.6 mil., with three peripheral edges of the resulting panel being glued or bonded to a depth, such as 3/16", less than the frame front aperture 32 to the sturdy frame backing 10, therewith creating an end insertion opening 14 for greeting card 9.

The peripheral edges of the frame front 7, plastic cheet 8, and frame backing 10 are co-extensive.

Figure 5:
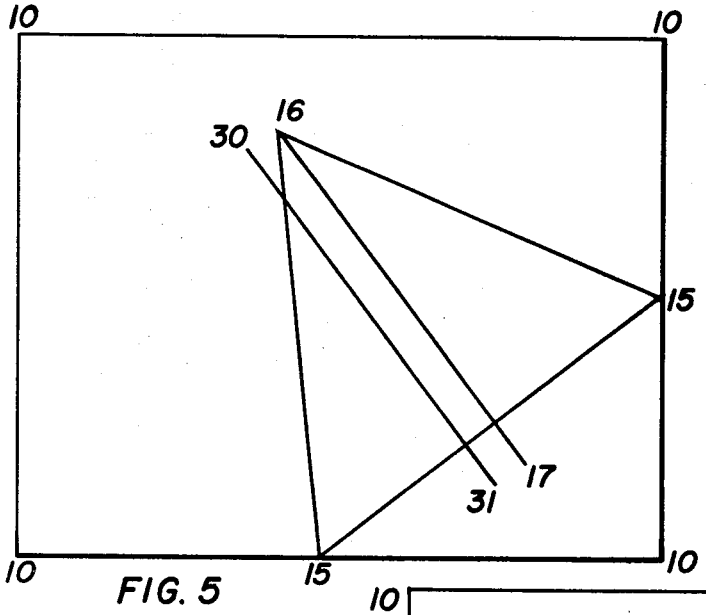
Figure 5B:
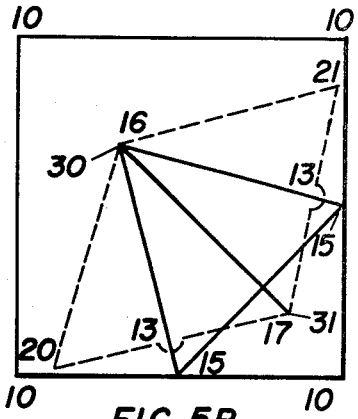
Figure 6B:
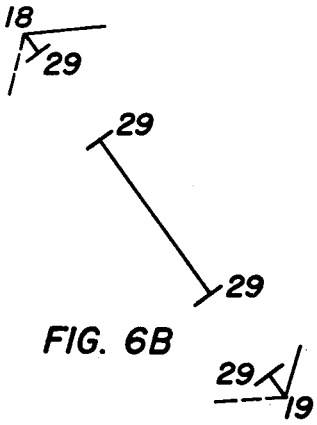
Figure 6:
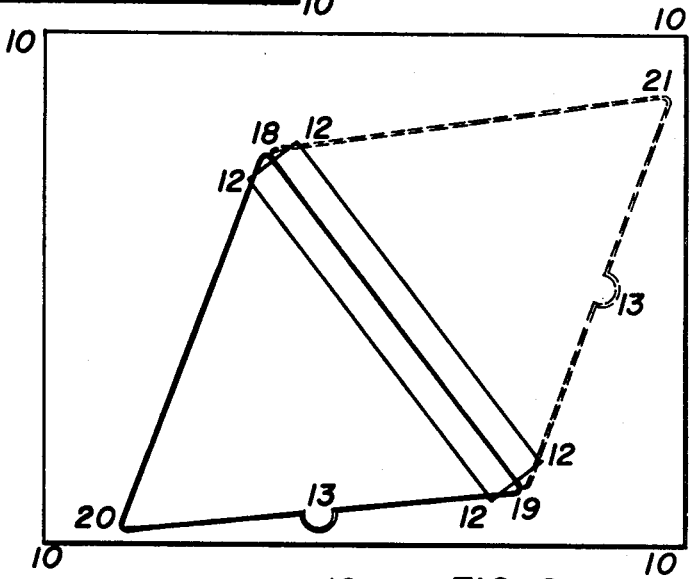

FIG. 2 further depicts wire standing/hanging easel 11 of which size, configuration, and attachment are determined in the following manner:

In FIGS. 5 and 5B center points 15 of two adjacent sides of frame backing 10 are line connected, the connector 15 employed as baseline in inscribing an equilateral triangle, size and configuration of which with the addition of a $\frac{1}{4}''$ center baseline standing/hanging protrusion give size and configuration for wire standing-/hanging easel 18-19-20 FIG. 6.

For square frame bisection of the equilateral triangle 15-15-16 FIG. 5B and extension of the bisector coextensive with the length of baseline 15 establishes easel attachment locator 30-31. For rectangular frame bisection of the equilateral triangle 15-15-16 FIG. 5 and extension of the bisector 16-17 coextensive with length of baseline 15 establishes angle and length of easel attachment locator 30-31, said locator being inscribed parallel to, coextensive with, and $\frac{1}{4}''$ farther along the longer side measurement of frame backing 10.

In FIG. 6 easel side member 18-19 attachment employs adhesive strip 12, vertical center of which is non-adhesive at point of contact with wire easel side member 18-19, permitting either side easel orientation and enabling vertical or horizontal frame utilization.

FIG. 6B depicts wire standing/hanging easel attachment by employment of two pairs horizontal slits 29 spaced at will along the attachment locator line 30-31, said slits 29 permitting threadthrough of wire standing-/hanging easel side member 18-19 for either side easel orientation and vertical or horizontal frame utilization.

Figure 6C:
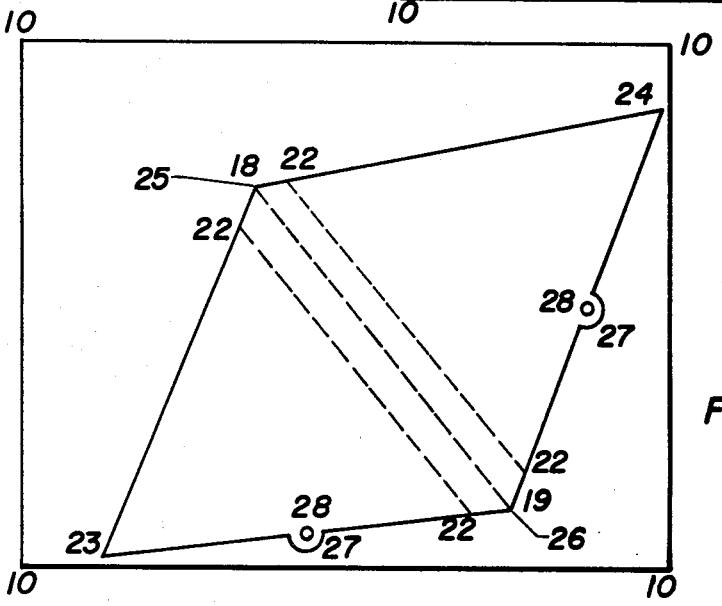

FIG. 6C shows employment of a double triangular standing/hanging easel 23-24-25-26 of frame backing, in size and configuration coextensive with two of the hereinbefore described equilateral triangles 15-15-16 and having a common joining side 25-26 and additionally having to right and left of the baseline joining point 26 a center $\frac{1}{4}''$ protrusion 27, $\frac{3}{4}''$ wide and centered with a $\frac{1}{4}''$ hanging aperture 28 providing either horizontal or vertical frame hanging orientation. Attachment of the easel 23-24-25-26 is by employment of adhesive gluing or bonding along and to either side of the attachment locator line 30-31 as necessary for securement 22, attachment providing standing horizontal or vertical frame utilization when easel unglued or unbonded side member 23 or 24 is extended.

What is claimed is:

1. A new and improved inexpensive standing/hanging, easel-backed greeting card display frame wherein a centrally apertured frame panel is permanently affixed on three peripheral side edges to a coextensive frame backing, therewith creating an end-insertion one-piece window greeting card display frame, to which for standing or hanging securement is attached either a wire easel, size and configuration coextensive with the equilateral triangle employing as baseline the connector between center points of two adjacent frame back sides and additionally employing a center baseline standing- /hanging protrusion, said easel being attached by adhesive strip which is nonadhesive at easel side member contact or being attached by side member thread-through of two pairs horizontal frame backing slits; or a double triangular frame backing easel, size and configuration coextensive with two of the hereinbefore described equilaterally constructed triangles, said two-triangle easel piece employing adhesive frame attachment along the common joining line and a standing/hanging protrusion with center aperture midway between said common joining baseline point and two outer corners; either easel attachment being along a line bisecting the constructed equilateral triangle top point and baseline center and extended in measurement coextensive to triangle side for square frames or along a line parallel to said bisector and one-quarter inch farther along longer frame side for rectangular frame.

* * * * *